United States Patent [19]

Minard

[11] Patent Number: 4,522,238

[45] Date of Patent: Jun. 11, 1985

[54] VALVE CONTROL MECHANISM FOR RECIPROCATING VALVES OF A POSITIVE DISPLACEMENT ROTARY FILLING MACHINE

[75] Inventor: Everett S. Minard, Sacramento, Calif.

[73] Assignee: Elmar Industries, Inc., Santa Clara, Calif.

[21] Appl. No.: 467,182

[22] Filed: Feb. 16, 1983

[51] Int. Cl.[3] ..... B65B 57/02

[52] U.S. Cl. ..... 141/142; 141/144; 141/147; 141/156

[58] Field of Search ..... 141/129, 147, 140–146, 141/155, 156, 258, 259; 251/251, 347

[56] References Cited

U.S. PATENT DOCUMENTS

| | | | |
|---|---|---|---|
| 2,759,649 | 8/1956 | Stigler | 141/146 X |
| 2,958,346 | 11/1960 | Kerr | 141/141 |
| 2,974,691 | 3/1961 | Bingham | 141/142 |
| 3,097,677 | 7/1963 | Minard | 141/142 |
| 3,589,410 | 6/1971 | Manas | 141/144 X |
| 3,826,293 | 7/1974 | Cayton | 141/142 |
| 3,841,363 | 10/1974 | Stigler | 141/142 |
| 3,889,726 | 6/1975 | Stigler | 141/142 |

*Primary Examiner*—Stephen Marcus
*Assistant Examiner*—Ernest G. Cusick
*Attorney, Agent, or Firm*—Theodore H. Lassagne

[57] ABSTRACT

A positive displacement rotary receptacle filling machine employs a receptacle detecting mechanism which detects the presence or absence of a receptacle in the file being fed to the machine at a point ahead of the filling position of such a receptacle and effects a presetting of the valve operating mechanism of such a machine at a point correspondingly ahead of the initial filling position, utilizing a settable trip shoe separate from the settable valve operating mechanisms of the machine for this purpose. The arrangement described results in a significant extension of the filling arc of the machine, making possible a corresponding significant increase in its speed.

4 Claims, 8 Drawing Figures

VALVE CONTROL MECHANISM FOR RECIPROCATING VALVES OF A POSITIVE DISPLACEMENT ROTARY FILLING MACHINE

BACKGROUND OF THE INVENTION

1. Field of the Invention

The present invention relates to receptacle filling machines, and more particularly to improvements in the valve control mechanisms of positive displacement rotary filling machines.

2. Description of the Prior Art

Rotary filling machines employing reciprocable pistons to effect positive discharge of product from a turret of cylinders through discharge nozzles associated with each cylinder into receptacles fed into a filling arc; i. e., that portion of a receptacle's travel during which it is positioned beneath a discharge nozzle, are well known and widely used.

Such machines generally comprise a vertically reciprocable plunger valve associated with each cylinder, which, in one of its two positions, opens communication between the cylinder and a product reservoir, and in the other position opens communication between the cylinder and the discharge nozzle.

In order to prevent the discharge of product when no receptacle is present beneath a discharge nozzle, various "no can no fill" mechanisms have been developed. These mechanisms sense the presence or absence of receptacles and control the associated valve so that if no receptacle is present beneath a given discharge nozzle, the discharge stroke of the piston will return the cylinder's content to the product reservoir instead of discharging it through the discharge nozzle.

Kerr U.S. Pat. No. 2,958,346 discloses two forms of "no can no fill" mechanisms, one employing a vertically reciprocating valve structure and the other a rotary valve structure. In both mechanisms the valve actuator is operated by a fixed cam, but does not actuate its associated valve unless a receptacle detector adjacent each receptacle position detects a receptacle in that position ready to be filled.

Minard U.S. Pat. No. 3,097,672 discloses a "no can no fill" mechanism in which the cam for operating the valve actuator has a displaceable entry ramp which can be lowered to prevent operation of one or more of the valve actuators by the cam. Displacement of the entry ramp is controlled by a single receptacle detector which causes lowering of the ramp when no receptacle is detected in the first position within the filling arc.

In order for such arrangements to function satisfactorily, the actuator-to-valve latching mechanism of Kerr or the entry ramp mechanism of Minard must be controlled and positioned in the space between filling stations; for, if there is only one receptacle missing in the line being fed to the machine, the "no can no fill" mechanisms must be set to "no can" condition for the missing receptacle and returned to normal condition for the next one.

Since the piston operating cam cannot be allowed to initiate the discharge stroke of the piston until the "no can no fill" mechanism has been set, and such setting cannot take place until a receptacle has been fed into the filling arc or the absence of one has been detected therein, the portion of the filling arc within which products can be actually discharged into a receptacle necessarily is reduced.

On the latest high speed machines, filling stations are spaced as closely together as four inches (10.16 cm) center to center, and generally a valve lift of at least $\frac{3}{4}$ of an inch (1.91 cm) is required to properly position the valve.

Since speeds of 1200 receptacles per minute are not uncommon today on 36 station filling machines, it will be seen that it has become almost impossible to design a "no can no fill" mechanism of the above described types which will operate in such a short distance at such speeds without any valve being improperly positioned, causing a very irregular filling pattern.

SUMMARY OF THE INVENTION

According to the present invention, a significant extension of that portion of a receptacle's travel through the machine during which products may be discharged into it, resulting in a possibility of increasing machine speed without loss of product due to slop-over, is achieved by an improvement of the "no can no fill" mechanism and extension of the piston and the valve operating cams to effect discharge of product into receptacles throughout the entire filling arc.

The "no can no fill" mechanism of the present invention is divided into three portions. (1) A receptacle detector for detecting the presence or absence of receptacles in the file being fed into the machine, positioned at a point outside the filling arc instead of within that arc as in previously known machines; (2) valve control means associated with each valve and settable to active or inactive position to determine whether or not its associated valve will be operated by the valve operating cam; and (3) a selectively settable trip shoe positioned ahead of the filling arc and controlled by the receptacle detector for setting said valve control means to active or inactive positions as they approach the filling arc.

By thus positioning the receptacle detector ahead of the filling arc and positioning the trip shoe controlled by it ahead of the filling circle, setting of the valve control means is accomplished before any receptacle is in a position to receive products from its cylinder, and no portion of the filling arc itself is occupied by the functioning of the "no can no fill" mechanism. Thus, it becomes possible to commence the discharge of product from a cylinder into a receptacle as soon as the leading edge of that receptacle has passed under the discharge nozzle of the cylinder and to continue the discharge of product into the receptacle until just before the trailing edge of a receptacle passes out from under the discharge nozzle.

DESCRIPTION OF THE PREFERRED EMBODIMENT

Figure 1:
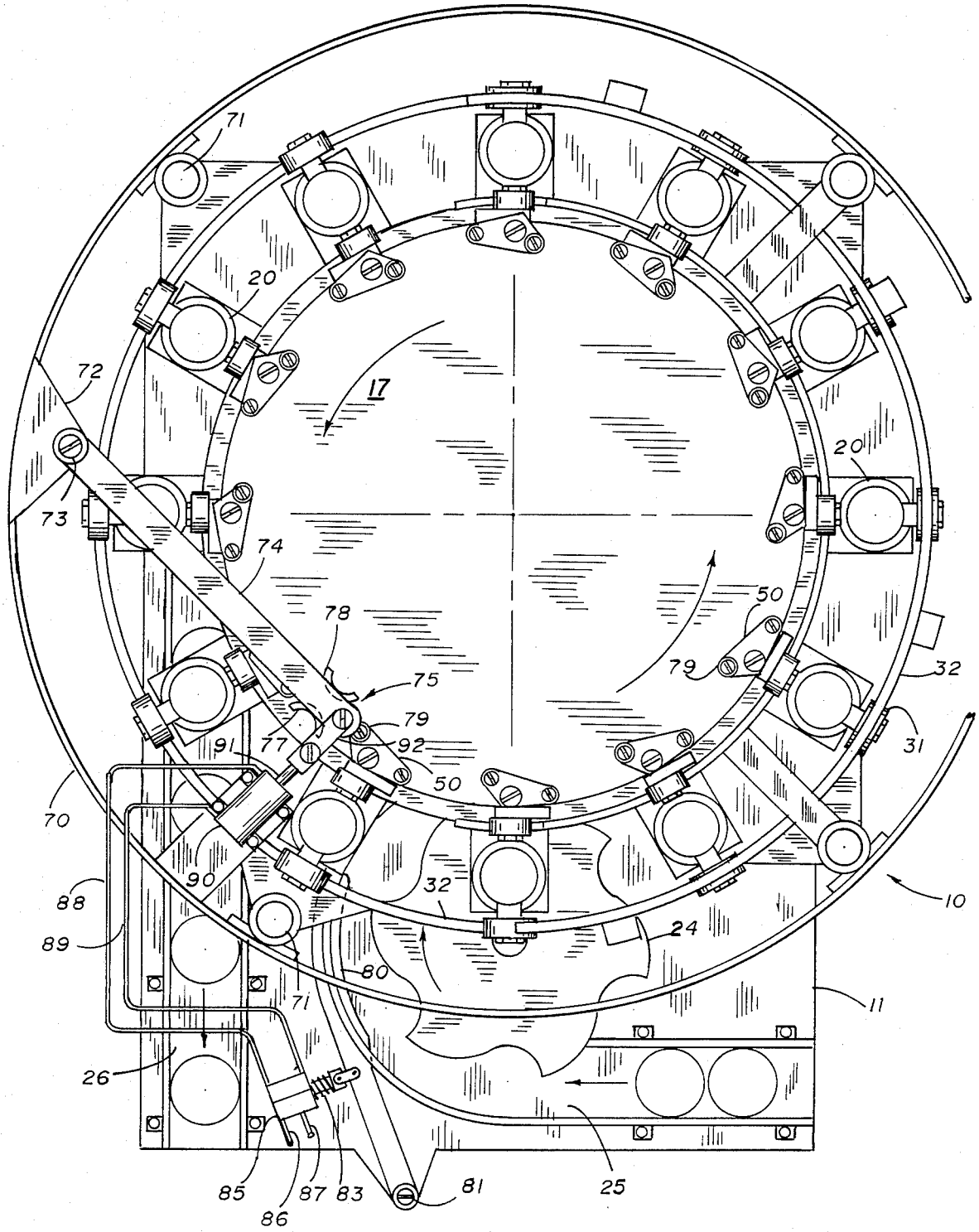
FIG. 1 is a view in top plan of a twelve station machine embodying the present invention.
Figure 2:
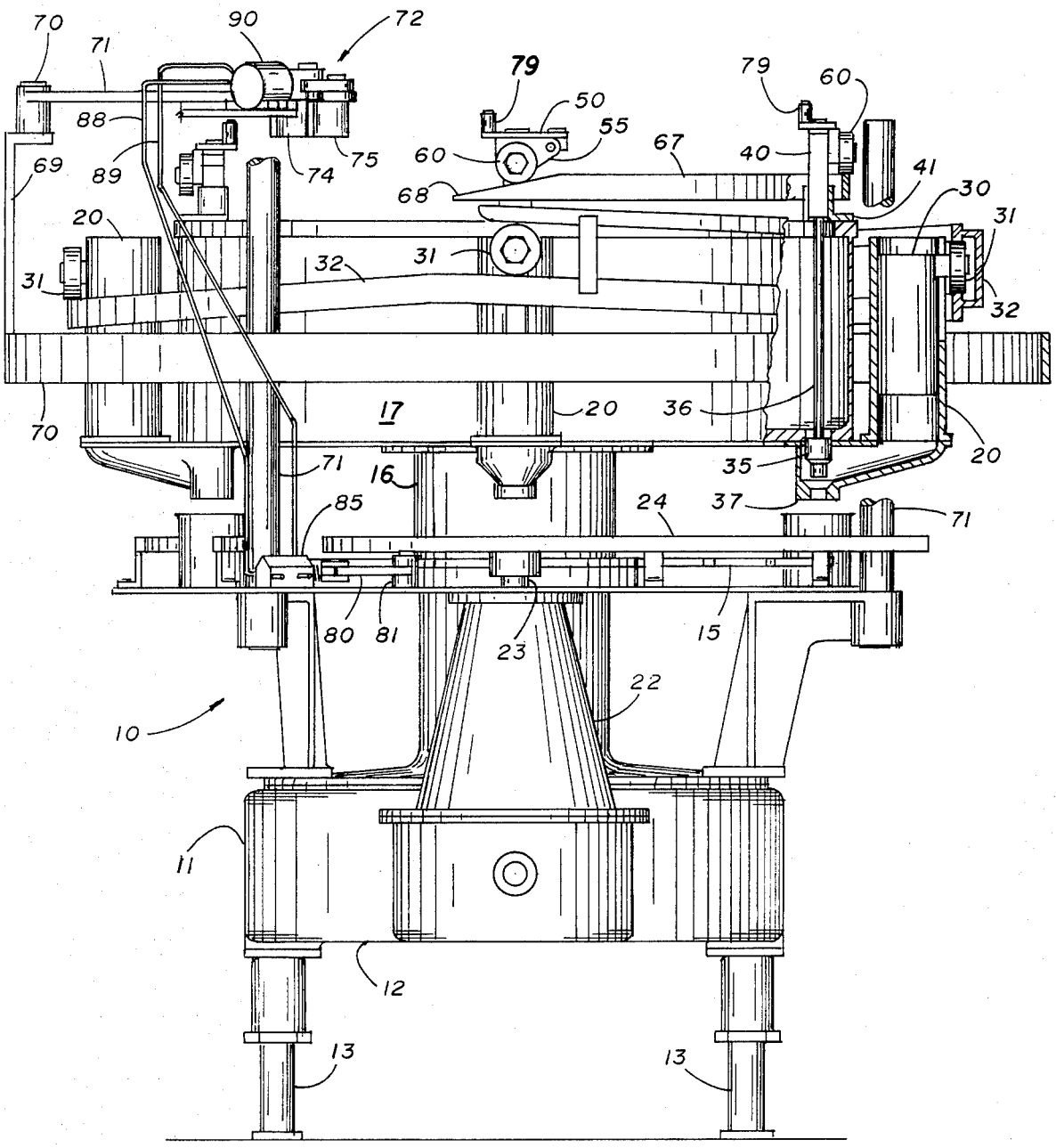
FIG. 2 is a view in side elevation of the machine of FIG. 1 with all the three stations removed to better show those remaining and with one station shown in vertical section.

As shown in FIGS. 1 and 2, the general structural arrangement of the machine of the present invention is similar to that of the U.S. Pat. No. 3,097,672 to Minard to which reference may be made for details not disclosed herein; a twelve station machine being illustrated in order to avoid complicating the disclosure.

The machine 10 has a stationary base assembly 11 comprising a gear case 12 supported on legs 13 containing drive gears, as shown and described in the above mentioned Minard patent. A receptacle conveying star wheel 15 is driven by these drive gears along with a support pedestal 16 carrying a central product reservoir 17 and a plurality of cylinders 20.

A conical pedestal 22 carried by the case 11 houses a shaft 23 driven by the gearing in gear case 12 which drives a receptacle feeding star wheel 24 the purpose of which is to feed receptacles from an in-feed conveyor 25 into the receptacle conveying star wheel 15 by which the receptacles are carried around the filling arc 10 by the latter and leave by an exit conveyor 26; the arrows in FIG. 1 indicating the direction of their movement through the machine.

As shown in FIG. 2, each of the cylinders 20 contains a piston 30 which is reciprocated therein by means comprising a cam following roller 31 actuated by a cam track 32 mounted on the frame of the machine.

Associated with each of the cylinders 20 is a valve 35 which is vertically reciprocable by means of a valve stem 36 and which, in its uppermost position, places the cylinder in communication with a discharge nozzle 37, while in its lowermost position it places the cylinder in communication with the interior of the central product reservoir 17. All of the foregoing structures are conventional and well known in the art, as shown and described in the aforementioned patent of Minard.

VALVE OPERATING MEANS

Figures 3, 4:
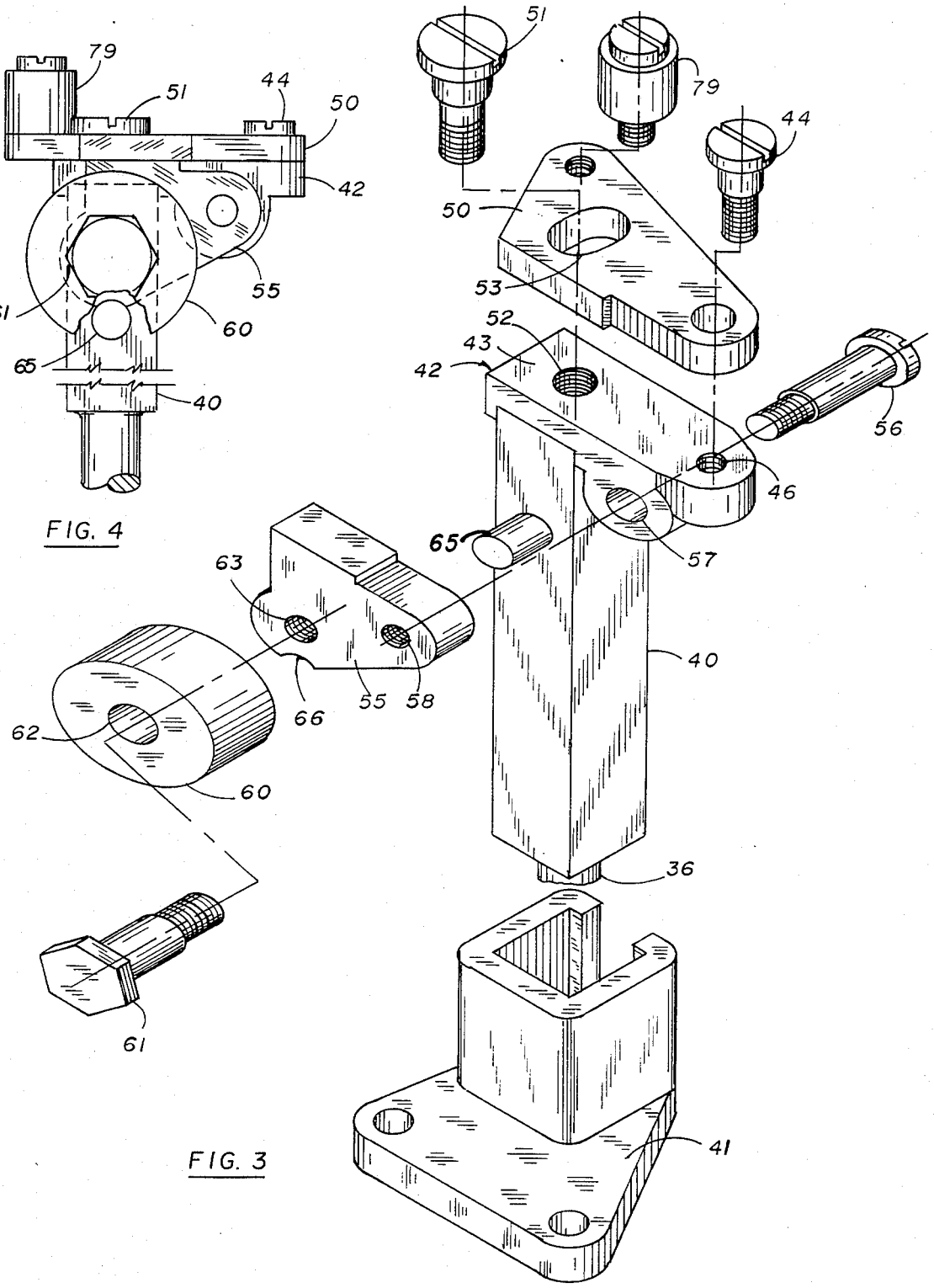
FIG. 3 is a view in exploded perspective of details of the valve's mechanism.
FIG. 4 is a detail view in side elevation of the upper end of a valve stem.

As shown in FIGS. 2, 3 and 4, the upper portion 40 of each valve stem 36 is non-circular in cross-section and is guided in a bracket 41 secured to the sides of the reservoir 17.

Secured to the upper end of the portion 40 is a plate 42 having a horizontal upper surface 43 on which there is pivotally mounted by means of a shouldered bolt 44 threaded into a recess 46 a locking plate 50. The pivotal movement of locking plate 50 is limited by a shouldered bolt 51 threaded into a recess 52 through an elongated aperture 53 in the locking plate 50.

A roller mounting plate 55 is pivotally mounted on one side of the plate 42 by a shouldered bolt 56 which passes through a bore 57 in plate 42 and engages a threaded recess 58 in the plate 55. A cam follower in the form of a roller 60 is rotatably mounted on the plate 55 by means of a shouldered bolt 61 which passes through a central bore 62 in the roller 60 and engages in a threaded recess 63 in plate 55. A pin 65 fixed on one side of the valve stem portion 40 is engageable with a groove 66 in the lower face of plate 55 to limit counterclockwise pivotal movement of the plate 55.

Figure 5:
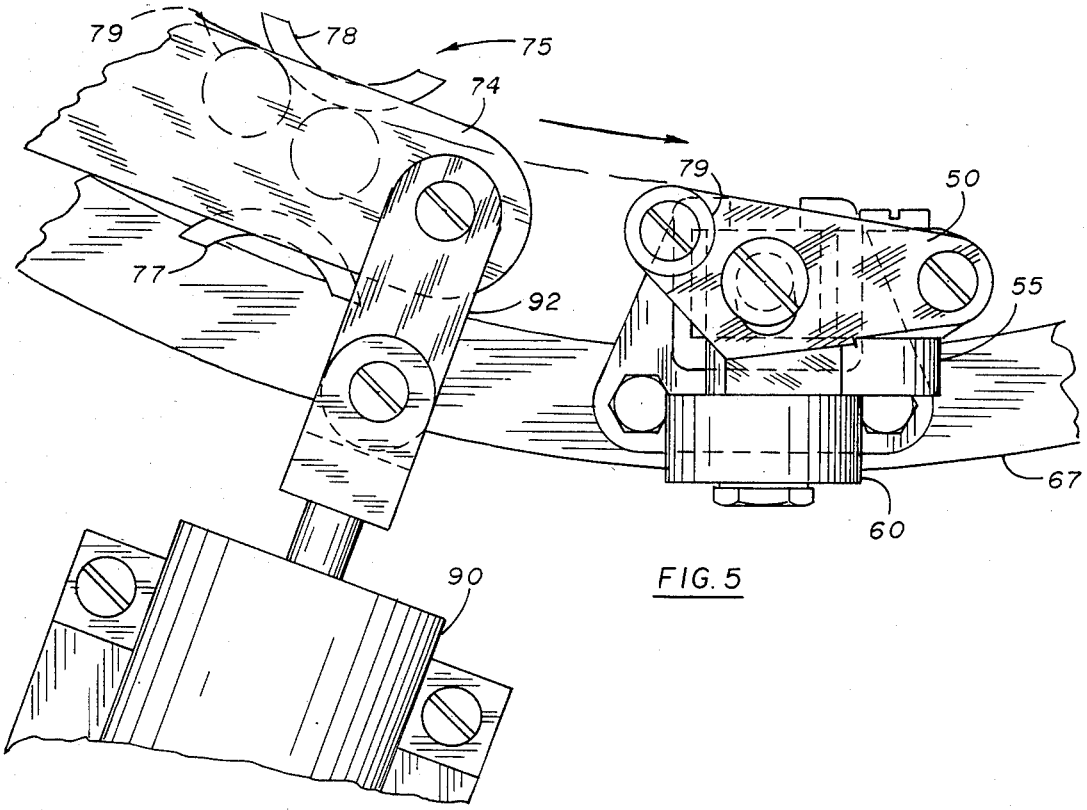
FIG. 5 is a detail view in top plan of a valve station showing the parts in active position.
Figure 6:
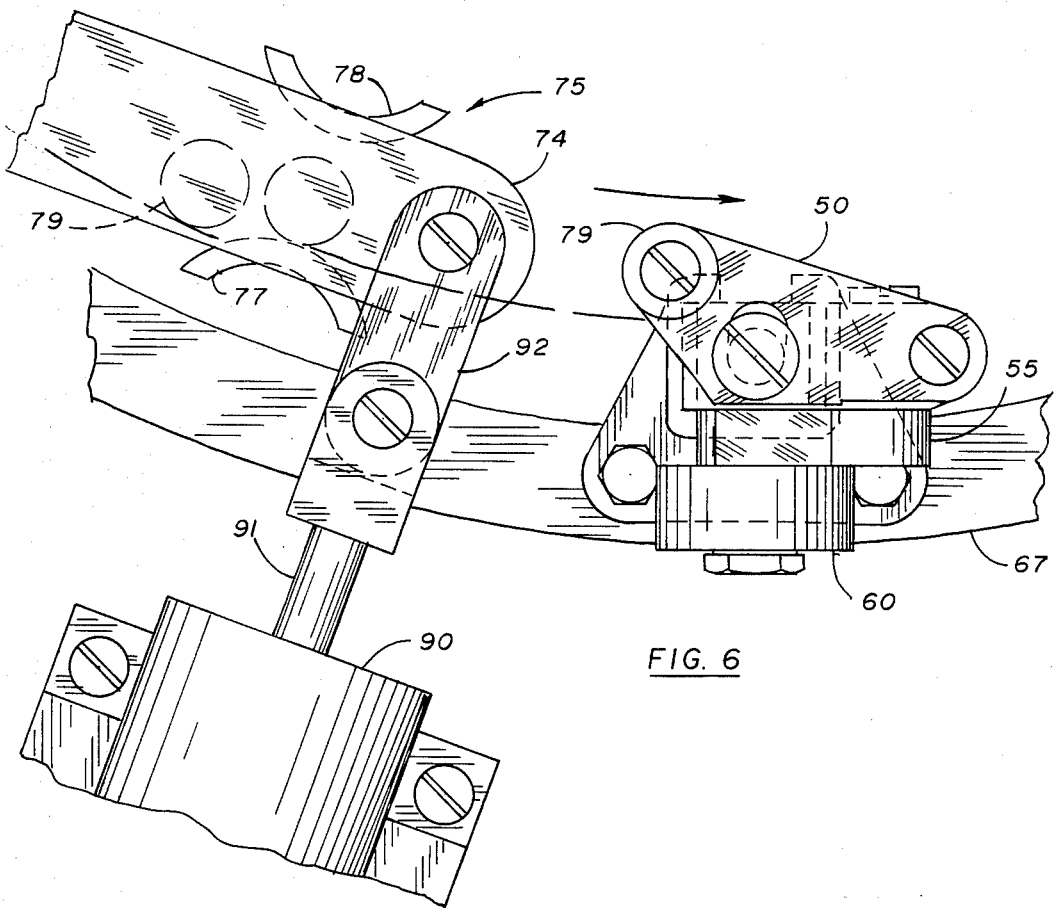
FIG. 6 is a similar detail view showing the parts in inactive or "no fill" position.

As shown in FIG. 2, roller 60 rides upon the upper edge of a cam 67 carried by the frame of the machine, so that when the roller rides up the entry ramp 68 of cam 67 it will raise the roller 60. If at that time the locking plate 50 is in the position in which it is shown in FIG. 5, the roller mounting plate 55 will be locked to the valve stem 40 by the overlying plate 50 and the valve stem 40 will be raised. However, if at that time the locking plate 50 is in the position in which it is shown in FIG. 6, the roller mounting plate 55 will be free to pivot clockwise, as viewed in FIGS. 3 and 4, about its axis on bolt 56 and the valve stem will remain in its lowered position.

The valve operating means thus comprises the cam track 67 with its entry ramp 68, the cam follower 55, 60 pivotally mounted at 56 on each of the valve stems 36, 40, and selectively settable valve control means 50 for either freeing the cam follower 55, 60 for pivotal movement on the valve stem 36, 40 or locking it against movement in relation to the valve.

TRIP SHOE ASSEMBLY

As shown in FIGS. 1 and 2, a support ring 70 supported on the frame of the machine by posts 71 carries a bracket 72 on which there is pivotally mounted at 73 an arm 74 of a trip shoe assembly 75.

The trip shoe assembly 75 comprises an outer trip shoe 77 and an inner trip shoe 78 secured to the arm 74 and positioned in the path along which rollers 79 carried on the locking plates 50 of the valve operating means move and the turret carrying cylinders 20 rotates.

As shown also in FIGS. 5 and 6, this arrangement is such that if the arm 74 is in the position in which it is shown in FIG. 5, any roller 79 carried by a locking plate 50 which is not already in the position in which it is locking its cam follower against movement in relation to its associated valve will contact the inner trip shoe 78 and be moved outwardly to the position in which it is shown at the rightmost portion of FIG. 5. However, if the arm 74 is in the position in which it is shown in FIG. 6, any roller 79 carried by a locking plate 50 which is not already in the position in which it frees its associated cam follower for pivotal movement on its associated valve will engage the outer trip shoe 77 and be moved thereby to the position in which it is shown in the rightmost portion of FIG. 6.

The trip shoe assembly thus comprises the selectively settable arm 74 with its outer and inner trip shoes 77 and 78 for setting the valve control means through contact with the rollers 79 as the valves move past the trip shoe assembly 75 during rotation of the filling stations.

RECEPTACLE SENSING MEANS AND TRIP SHOE SETTING

Means are provided for sensing the presence or absence of a receptacle in the file of receptacles being supplied to the machine along its infeed conveyor 25. The trip shoes 77 and 78 of the trip shoe assembly are located in advance of the first filling position of the machine so that the locking plates 50 always are set before the filling station with which they are associated reaches the first filling position. Consequently the receptacle sensing means must be located radially outward of the receptacle conveying star wheel at a distance from the first filling position corresponding to the distance separating the inner and outer trip shoes 77 and 78 from the first filling position. In this way the sensing of the presence or absence of a receptacle at the sensing means will result in the proper setting of the trip shoe assembly and the consequent setting of the locking plate 50 at a filling station which will reach the first filling position at the same time the receptacle or the empty pocket which caused it to be set also reaches the first filling position.

In the embodiment of the invention illustrated and described herein, as shown in FIGS. 1 and 2, an arcuate sensing segment 80 is pivoted to the frame of the machine at 81 and presents an arcuate face to the receptacles being fed into the machine by the receptacle feeding star wheel 24. A compression spring 83 (FIG. 1) urges the segment 80 into contact with receptacles entering the machine, and since the segment 80 is of sufficient length to span the distance between two receptacles being carried along by the star wheel 24, it will remain in contact with receptacles with the spring 83 compressed unless and until a vacancy occurs in one of the pockets of the star wheel 24. Upon the occurrence of such a vacancy, segment 80 will move inward toward the center of the stan wheel 24 position where it will remain unless and until another receptacle is fed into contact with it by the star wheel 24.

Motion of the sensing segment 80 is transmitted to the trip shoe assembly 75 by means comprising an air control valve 85 fed by compressed air and exhaust lines 86 and 87, respectively. Air lines 88 and 89 connect the air valve 85 to the air cylinder 90 the piston of which is connected by rod 91 to arm 74 by means of link 92 which is pivotally connected to the arm 74 and the rod 91 at its opposite ends (see also FIGS. 5 and 6).

OPERATION

Figure 7:
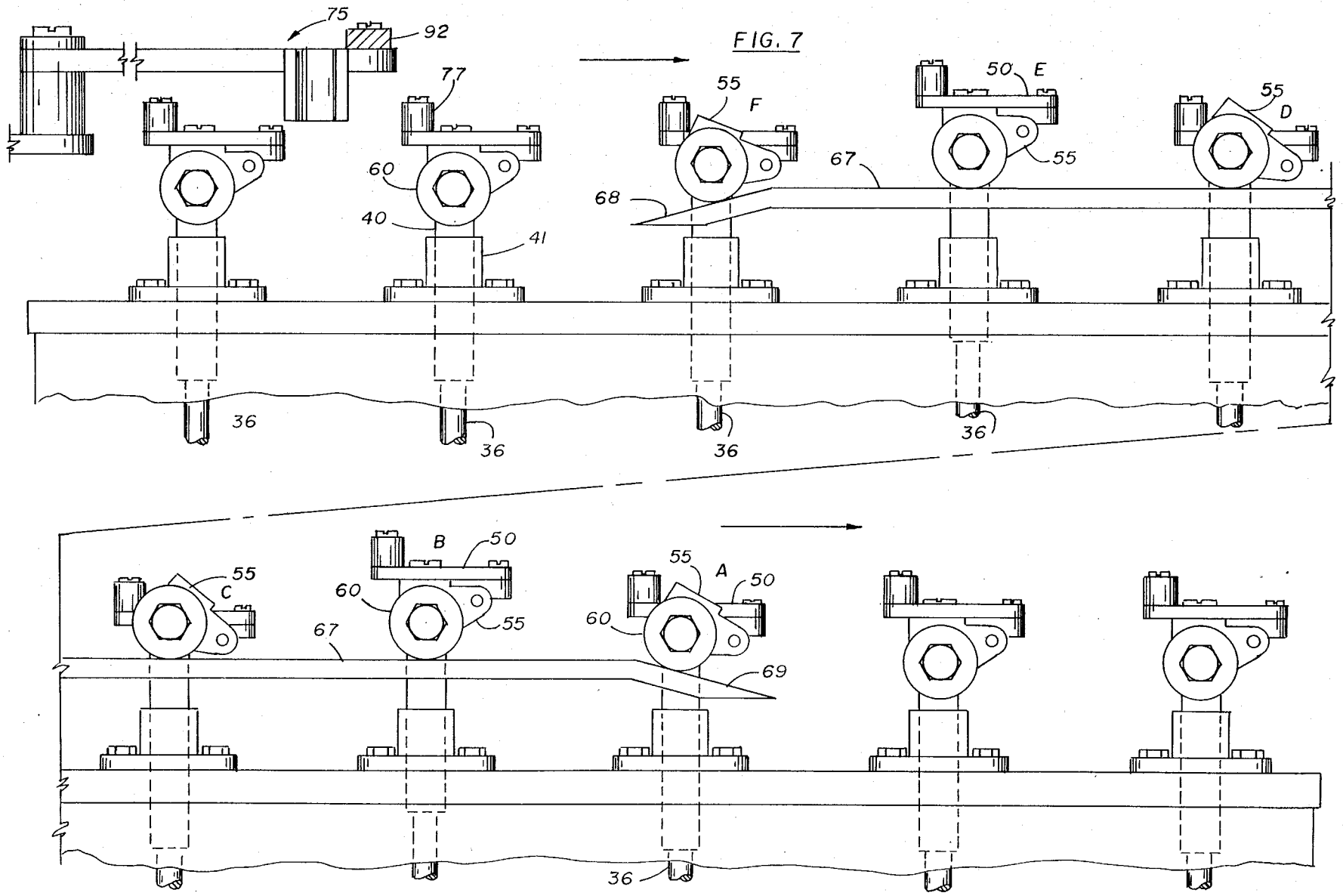
FIG. 7 is a schematic view showing the upper portions of the valve stems within the filling circle and associated parts.

FIG. 7 illustrates the operation of the valve operating mechanisms in response to operations of the receptacle sensing mechanism and the trip shoe assembly.

The locking plate 50 of the valve operating mechanism designated A, the roller 60 of which is on the exit ramp 69 of the cam 67, was set to the inactive position in which it is shown in FIG. 6 by the antecedent action of the trip shoe assembly 75, as is evident from the lower position of the valve stem 36 and the clockwise pivoted position of the roller mounting plate 5.

After the valve operating unit designated A had passed the trip shoe assembly 75, however, it is evident that a receptacle was sensed in the next star wheel position, causing the trip shoe assembly to be moved to the position in which it is shown in FIG. 5. This caused the locking plate 50 of that unit to be set to the position shown in FIG. 5 so that when the unit designated B arrived at the entry ramp 68 of the cam 67, the roller mounting plate 55 was locked against clockwise movement, and the roller 60 therefore lifted the valve stem 36 to the raised position in which it is shown.

In the case of the unit designated C, the receptacle sensing mechanism again caused the trip shoes 77 and 78 to be moved back to the position shown in FIG. 6 permitting the roller mounting plate 55 to pivot clockwise, as shown, leaving the valve stem 36 in its lowered position. No change in the setting of the trip shoe assembly 75 took place between the passage of the unit designated C and that designated D, so the unit designated D also left the valve stem 36 in its lowered position. Between the passage of unit D and unit E, however, the trip shoe assembly 75 again moved to the position shown in FIG. 5, locking the roller mounting plate 50 to the valve stem and resulting in a raising of the valve stem 36. Between the passage of unit E and unit F, however, the trip shoe assembly 75 moved back to the position in which it is shown in FIG. 6, so that when unit F arrived at the position in which it is shown on the entry ramp 68, the roller mounting plate 55 was permitted to pivot clockwise, leaving the valve stem 36 in its lowered position.

Figure 8:
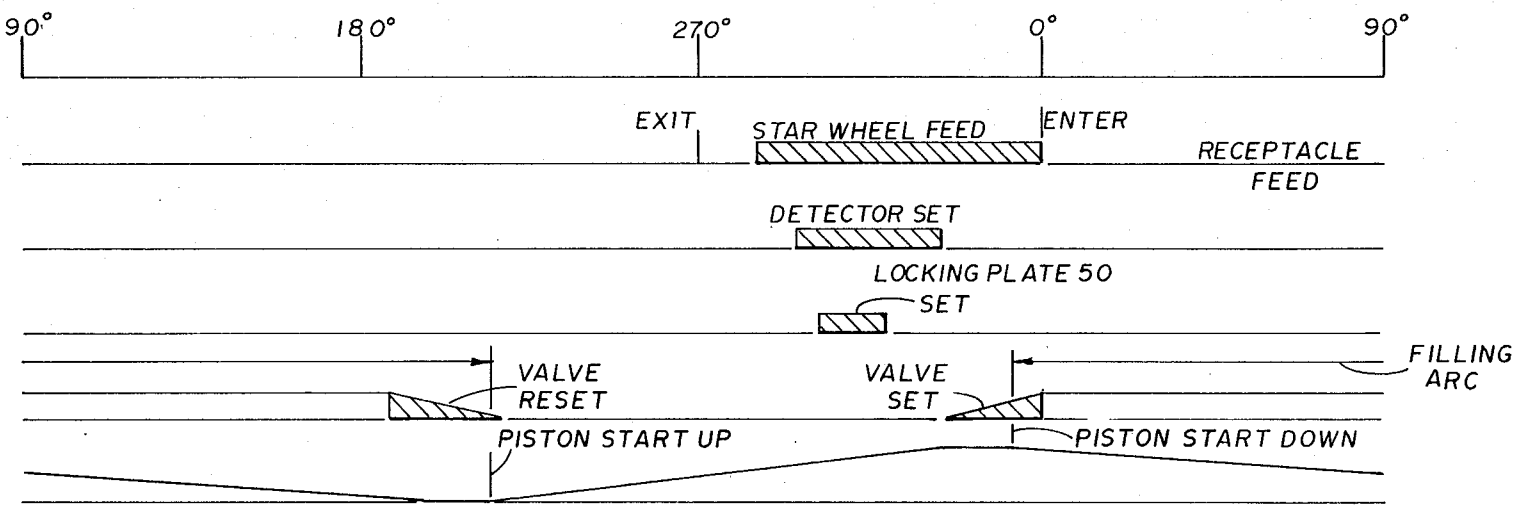
FIG. 8 is a timing chart illustrating the sequences and intervals of operations in the machine of the present invention.

The timing chart of FIG. 8 illustrates graphically the manner in which a locking plate 50 of a valve operating mechanism may be set in its inactive or active position by the operation of the receptacle detector and the trip shoe assembly 75 concurrently with the operation of the latter, thus permitting the valve to be moved to discharge position much earlier in the machine cycle than in the case of prior art structures. This results in a substantial extension of the filling arc, since the piston may start its discharge stroke as soon as the leading edge of a receptacle is under the discharge nozzle and even before the valve is fully opened to the discharge position. Because of the possibility of the piston discharging a portion of the cylinder's contact back into the reservoir by reason of the intermediate positioning of the valve at the commencement of the piston stroke, it may be necessary to compensate for such a return discharge by means of a slight increase in capacity of the cylinder, but in any event no product waste is involved.

While the present invention has been described herein in the preferred embodiment as embodied in a 12 station filling machine, it will be understood that this has been done for the purpose of avoiding the complication which would be involved in disclosing it in connection with a larger machine such as a 36 station machine of the type in general use at the present time.

I claim:

1. In a filling machine comprising a frame
having rotatably mounted on an axis thereon
a reservoir,
a plurality of filling stations
each including
a cylinder,
a piston reciprocable therein,
a discharge nozzle, and
a valve selectively positionable to place said cylinder into communication with either said discharge nozzle or said reservoir; and
a filling star for holding cans beneath said discharge nozzles as said filling stations are rotated on said frame; and
means comprising a feed star rotatable on a separate axis in synchronism with said filling star for supplying empty cans to said filling star the improvement comprising
a no-can-no-fill valve operating means comprising
a cam track,
a cam follower pivotally mounted on an axis on each of said valves, valve control means selectively settable to either free said cam follower for pivotal movement on said valve without displacement of said valve or to lock said cam follower against movement in relation to said valve whereby said valve will be displaced by said cam follower as it moves along said cam track, and a selectively settable trip shoe assembly carried by said frame at a position in advance of the position at which receptacles are fed to said filling star by said feed star for setting said valve control means to either of its aforesaid settings according to the setting of said trip shoe assembly, as said valves move past said assembly during rotation of said filling stations whereby said valve control means are reset to a different setting only in response to a change in the setting of said trip shoe assembly.

2. In a filling machine according to claim 1 the improvement comprising, additionally, receptacle sensing means including a sensing segment positioned and dimensioned to bridge the space between two receptacles radially outward of the periphery of said filling star, and means controlled by said sensing means for setting said selectively settable trip shoe assembly.

3. In a filling machine comprising a frame having rotatably mounted on an axis thereon a reservoir, a plurality of filling stations each including a cylinder, a piston reciprocable therein, a discharge nozzle, and a valve selectively positionable to place said cylinder into communication with either said discharge nozzle or said reservoir; and a filling star for holding cans beneath said discharge nozzles as said filling stations are rotated on said frame; and means comprising a feed star rotatable on a separate axis in synchronism with said filling star for supplying empty cans to said filling star the improvement comprising valve operating means comprising (a) a cam track, (b) a cam follower associated with each of said valves, (c) selectively settable valve control means settable to either free said cam follower for movement relative to said valve or lock said cam follower against movement in relation to said valve, and a selectively settable trip shoe assembly carried by said frame at a position in advance of the position at which receptacles are fed to said filling star by said feed star for setting said valve control means to either of its aforesaid settings according to the setting of said trip shoe assembly as said valves move past said assembly during rotation of said filling stations whereby said valve control means are reset to a different setting only in response to a change in the setting of said trip shoe assembly.

4. In a filling machine according to claim 3 the improvement comprising, additionally, receptacle sensing means positioned at a point in advance of said filling star, and means controlled by said sensing means for setting said selectively settable trip shoe assembly.

* * * * *